US005322982A

United States Patent [19]

Leger et al.

[11] Patent Number: 5,322,982

[45] Date of Patent: Jun. 21, 1994

[54] FUSIBLE SWITCH

[75] Inventors: Ricky D. Leger, Richmond; Russell Cox, Frankfort, both of Ky.

[73] Assignee: Square D Company, Palatine, Ill.

[21] Appl. No.: 878,782

[22] Filed: May 5, 1992

[51] Int. Cl.[5] ..... H01H 5/06

[52] U.S. Cl. ..... 200/401; 200/443; 200/306

[58] Field of Search ..... 200/401, 443, 144 R, 200/306

[56] References Cited

U.S. PATENT DOCUMENTS

| | | | |
|---|---|---|---|
| 1,846,841 | 2/1932 | Burnham | 200/306 X |
| 2,863,016 | 12/1958 | Hercules | 200/443 |
| 3,632,939 | 1/1972 | Yorgin et al. | 200/306 X |
| 4,005,297 | 1/1977 | Cleaveland | 200/144 B |
| 4,302,643 | 11/1981 | Cox et al. | 200/144 R |

*Primary Examiner*—Renee S. Luebke

*Attorney, Agent, or Firm*—Larry I. Golden; Kareem M. Irfan

[57] ABSTRACT

The present invention relates to a fusible switch for use in a multiphase circuit. The switch includes an operating mechanism which is secured to the enclosure of the switch and provides for a handle to operate the opening and closing of switch contacts. Movement of the handle stores energy in the operating mechanism which is subsequently released in a quick motion just as the switch contact is to be opened or closed. The switch also provides for heat sinks and means for venting the enclosure to dissipate the heat created from the higher voltage and greater current density carried by this improved switch.

23 Claims, 6 Drawing Sheets

FUSIBLE SWITCH

FIELD OF THE INVENTION

The present invention relates to a fusible switch for commercial and industrial switchboard applications and more particularly to an improved multiphase switch providing operation at a higher voltage and current density.

BACKGROUND OF THE INVENTION

A fusible switch is usually mounted in an enclosure and incorporates an insulating base to carry an incoming line terminal for each phase. The circuit for each phase is completed through a pivotal knife blade which engages a corresponding contact stab and is electrically connected with a fuse clip having a fuse seated therein. In U.S. Pat. No. 4,302,648, commonly assigned to the Square D Company, a fusible switch is shown utilizing the above mentioned construction and which is hereby incorporated by reference.

Fusible switches are used in switchboards to distribute power for commercial and industrial applications. The need arises to distribute more power through enclosures which are the same size or smaller. This requires increasing the electrical rating of the switch to carry a higher voltage and current density while decreasing the size of the enclosure housing the electrical parts.

Among the problems caused by increasing the electrical rating of a switch is the heat emitted by the current carrying parts and the arc created by operating the switch. The parts can be damaged without proper ventilation of the switch and dissipation of the heat build-up.

Furthermore, the switch must be economical to manufacture. A switch with a higher electrical rating at comparable cost allows more widespread application. This also alleviates the problem of selecting an appropriate class of fuse.

SUMMARY OF THE INVENTION

The present invention includes a fusible switch for use in a circuit having at least one phase. The switch includes an enclosure defining a switch interior formed by end walls, side walls, a back wall, and a front wall. The front wall has a cover removably connected thereto. The switch also includes a base formed of an electrically insulating thermoplastic material. The base secures to the enclosure within the interior. A pair of electrical terminals corresponding to each phase secures on opposite ends of the base. A knife blade and corresponding switch contact for each phase connects to one of the electrical terminals. Each knife blade pivots about the electrical terminal to disengagingly connect with the corresponding switch contact. Each knife blade attaches to a rotor, whereby, movement of the rotor simultaneously pivots each knife blade about a common axis between open and closed positions with each corresponding switch contact The switch also includes an operating mechanism secured directly to the side wall of the enclosure. The operating mechanism includes a handle extending through the front wall of the enclosure, energy storage means connected to the handle for storing energy created by movement of the handle and subsequently releasing the energy, and lost motion means connecting the handle and energy storage means to the rotor. The lost motion means provides for the movement of the handle to store energy prior to engaging the rotor and applying the stored energy to the rotor to quickly engage or disengage the knife blade and switch contact. A pair of fuse lugs for each phase are connected to one of the electrical terminals.

Preferably, the present invention includes a heat sink connected to the terminals to effectively provide additional surface area for dissipating heat. The switch also includes means for venting the enclosure to allow the circulation of air in proximity to the terminals.

An object of the present invention is to provide switch capable of operating at a higher voltage and greater current density in a more compact design.

Another object of the present invention is to provide a switch which prevents accidental electrical contact and provides greater application in the commercial and industrial environment while being economical to manufacture.

Other and further advantages, embodiments, variations and the like will be apparent to those skilled in the art from the present specification taken with the accompanying drawings and appended claims

BRIEF DESCRIPTION OF THE DRAWINGS

In the drawings, which comprise a portion of this disclosure.

DETAILED DESCRIPTION

Figure 1:
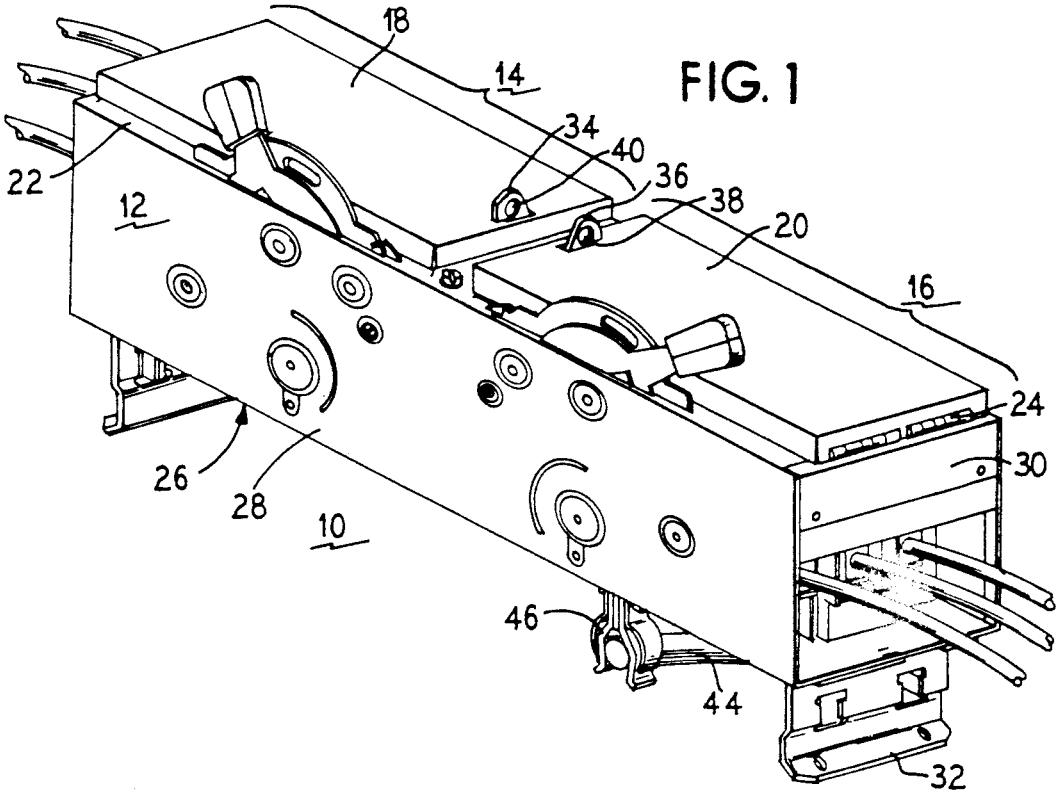
FIG. 1 is a perspective view of a fusible switch in accordance with the present invention.

Referring now to FIGS. 1 through 4, a fusible switch assembly for a multiphase circuit is indicated by the reference character 10. The switch assembly 10 includes an enclosure 12 divided between two switches generally designated as 14 and 16. Each switch is enclosed by a cover 18 and 20 respectively which connects to the front wall 22 of the enclosure by hinge 24.

The enclosure 12 is further defined by a back wall 26, side walls 28, and end walls 30. Mounting brackets 32 are connected to the back wall 26 and are utilized to attach the switch assembly 10 to the framework of a switchboard (not shown).

Each cover 18, 20 is respectively held in the closed position by a latch 34 and 36 which is shaped with an indent 38 for abutting and retaining the cover 20. The cover 20 is opened by pushing the latch 36 to one side to clear the indent 38. The latch extends against a spring (not shown) which returns the latch to its original position. Each latch 34 includes an aperture 40 adapted for receiving a padlock 42 to prevent the latch from opening. Each latch 34 can have its own padlock or one padlock with a sufficiently long shank can be positioned through both apertures.

In a multiphase circuit, there is an electrical power line connection for each respective phase. The switch assembly described and illustrated herein is for a three phase circuit. In accordance with the teachings available in the electrical art, it would be within the skill of one to change the number of phases and modify the invention accordingly.

Accordingly, the switch assembly 10 is illustrated connecting to an electrical bus bar or power line 44 with contact jaws 46. There is a contact jaw connection for each of the three phases. The contact jaw 46 is connected to a line feed bar 48 which extends through the back wall 26 into the interior of the enclosure 12. The line feed bar 48 is protected from grounding with the back wall 26 by insulators 50. The line feed bar 48 subsequently splits to connect with both switches 14, 16. For each phase, there is an outgoing load line 52. Each load line 52 extends through the end wall 30 to make external connection with the power distribution system.

Figure 2:
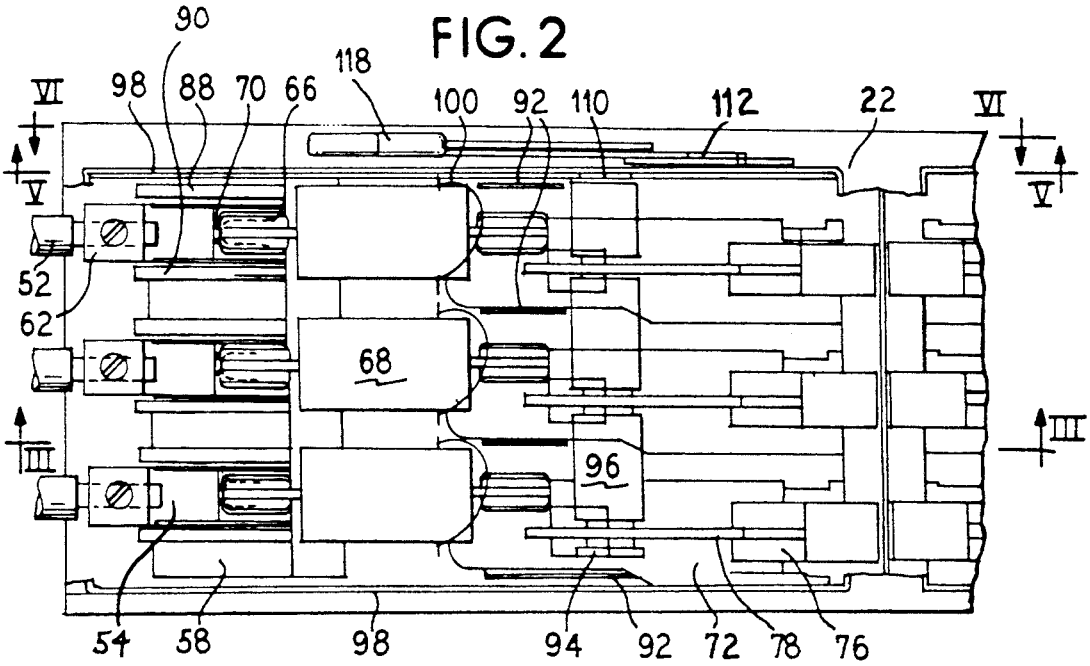
FIG. 2 is a top plan view of the switch of FIG. 1 with the cover open and the arc suppressor assembly removed

Referring specifically to FIG. 2, each switch unit like 16 includes a load base assembly 54 and a line base assembly 56 within the interior of the enclosure 12. The load base assembly 54 includes a load insulating base 58 integrally formed of a known insulating material such as the thermoplastic sold by the General Electric Company under the name Valox 420 or 750. The load insulating base 58 is secured to the back wall 26 near the end wall 30. Any conventional means for fastening the load insulating base 58, such as a sheet metal screw or bolt 60, is suitable.

A plurality of load terminals 62 are mounted in spaced apart positions on the load insulating base 58. Each phase connects a load line 52 to a respective load terminal 62. A fuse lug 64 is connected to each load terminal 62 and includes a pair of cantilever arcuate jaw members 66 for receiving the end of a fuse 68 therebetween. The jaw members 66 are reinforced with a wire 70 located on the outer side of each jaw member to prevent excessive bending when the fuse end is inserted.

The line base assembly 56 similarly includes a line insulating base 72 secured to the back wall 26 by a fastener such as a screw or bolt 74. A plurality of switch contacts 76 are mounted in spaced apart positions on the insulating base 72 and connect to the respective line feed bars 48. Each switch contact 76 includes a pair of upstanding cantilever spring legs forming a pair of spring jaws for receiving a respective switch or knife blade 78 between the respective jaws.

For each phase, the knife blade 78 is secured between the vertical legs of a line terminal 80 by a rivet 82 or the like for a pivoting movement about a common axis for each blade 78. Line terminal 80 is secured to the line insulating base 72 and is electrically connected to a fuse lug 84. The fuse lug 84 includes a pair of cantilever arcuate jaw members 86 for receiving the end of the fuse 68 For each phase, the spaced apart positions of the load terminals 62, fuse lugs 64, fuses 68, fuse lugs 84, line terminals 80, knife blades 78, and switch contacts 76 correspond in alignment so that an electrical connection is provided through the switch contacts 76 and fuse 64 between the load line 52 and the line feed bar 48.

Partition walls 88 are located between each load terminal 62 and fuse lug 64 on the load base assembly 54 as well as between the side walls 28 and the load terminals Partition walls 90 are similarly located between each line terminal 80 and fuse lug 84 on the line base assembly 56 as well as between the side walls 28 and the line terminals 80. Partition walls 88 and 90 are integrally formed with the insulating bases 58 and 72 respectively and extend in a perpendicular position therefrom. Made of a conventional insulating material, the partition walls 88 and 90 electrically insulate the line, load, switch, and fuse connections for each phase from one another.

The outer partition walls 92 located on the line base assembly 56 are provided with respective aligned recesses 94 for receiving a rotor 96 which carry the knife blades 78. The rotor 96 is seated between the edges of the recesses 94 and between the switch contacts 76 and the knife blades 78. Rotating the rotor 96 engages and disengages the switch contacts 76 and the knife blades 78.

The side walls 26 are protected by a flexible shield 98 made of a phenolic material or other arc resistant composition. The shield 98 protects the side walls 26 and other components from damage by an are during operation of the switch assembly 10. Fuses 68 are easily removed by fuse pullers 100.

Each switch contact 76 is overlapped by an arc suppressor assembly 102 attached to the line base assembly 56. The arc suppressor assembly 102 is a one piece housing made of a thermoplastic material similar to that described for the base assemblies. The arc suppressor assembly 102 effectively surrounds the switch contacts 76 to protect the other components in the enclosure 12 from damage by the arc released when the knife blade 78 engages or disengages the switch contacts 76. The arc suppressor assembly 102 includes a top wall 104 having a forwardly extending portion seating on a plurality of pairs of spaced apart side walls like 106. These side walls 106 in combination with a rear wall 108 form an arc chamber for each switch contact 76.

Figure 3:
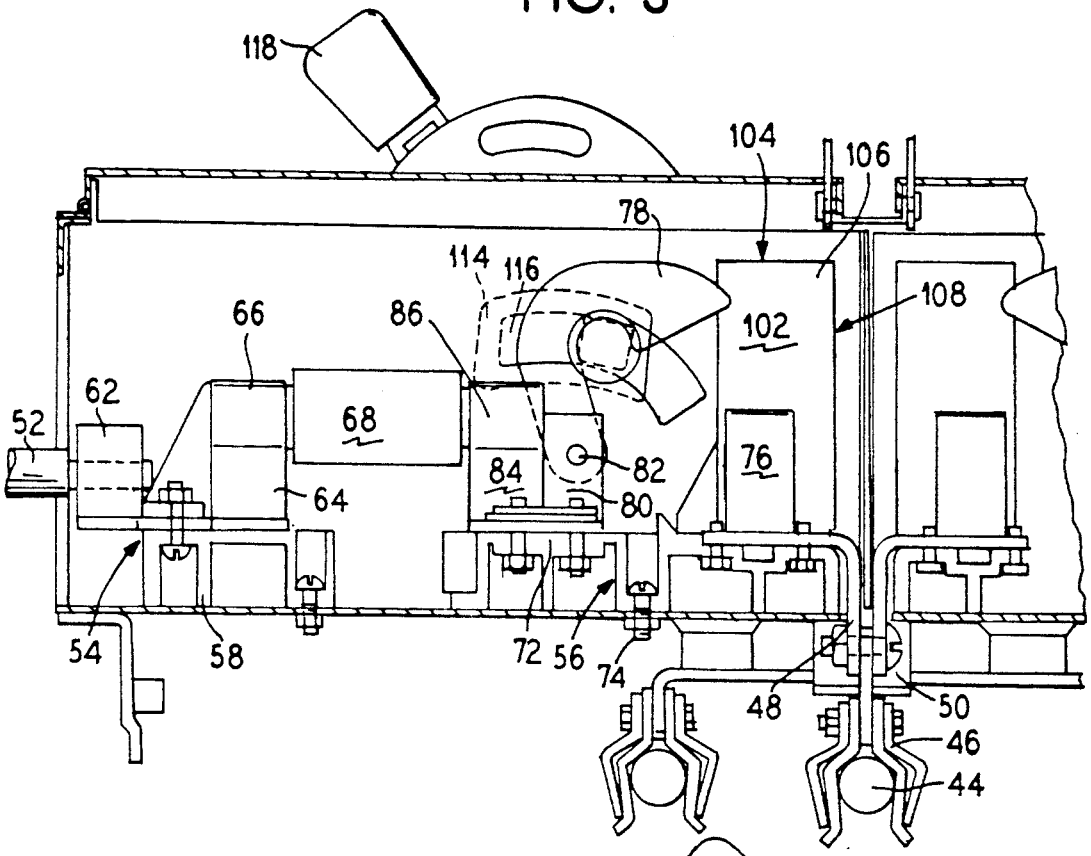
FIG. 3 is a sectional view taken along line III—III in FIG. 2 with the operating handle and the knife blade in the open position.
Figure 4:
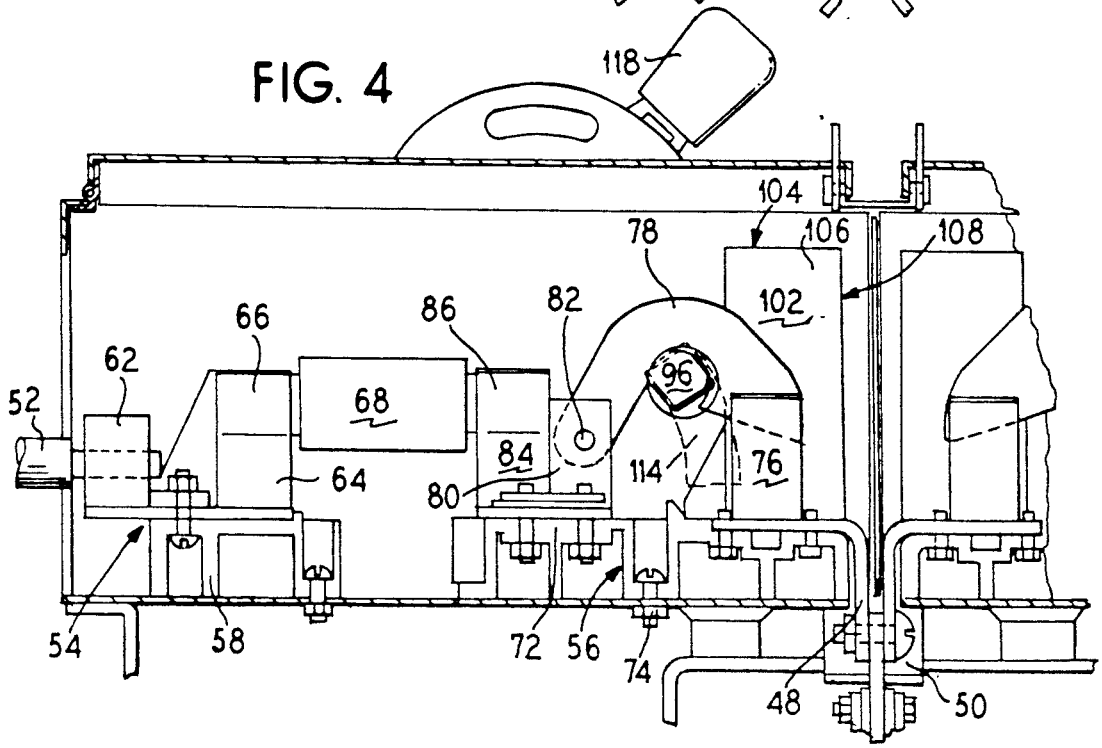
FIG. 4 is the sectional view of FIG. 3 with the operating handle and knife blade advanced to the closed position.

One end of the rotor 110 radially extends to engage an operating mechanism assembly 112. As best illustrated in FIGS. 3 and 4, the rotor 96 extends through a slot 114 in a loss motion cam 116. When the handle 118 is in the OFF position, the knife blade 78 is disengaged from the switch contact 76. As the handle 118 is advanced to the ON position in FIG. 4, the loss motion cam 116 moves forward to engage the rotor 96 at slot end 120 and move both the rotor 96 and knife blade 78 past a spring loaded over-centered position which will be discussed later. Once past the over-center position, the force of the spring pushes the rotor 96 to slam the knife blade 78 into engagement with the switch contact 76. The spring forces the rotor 96 to travel from slot end 120 to slot end 122.

Figure 5:
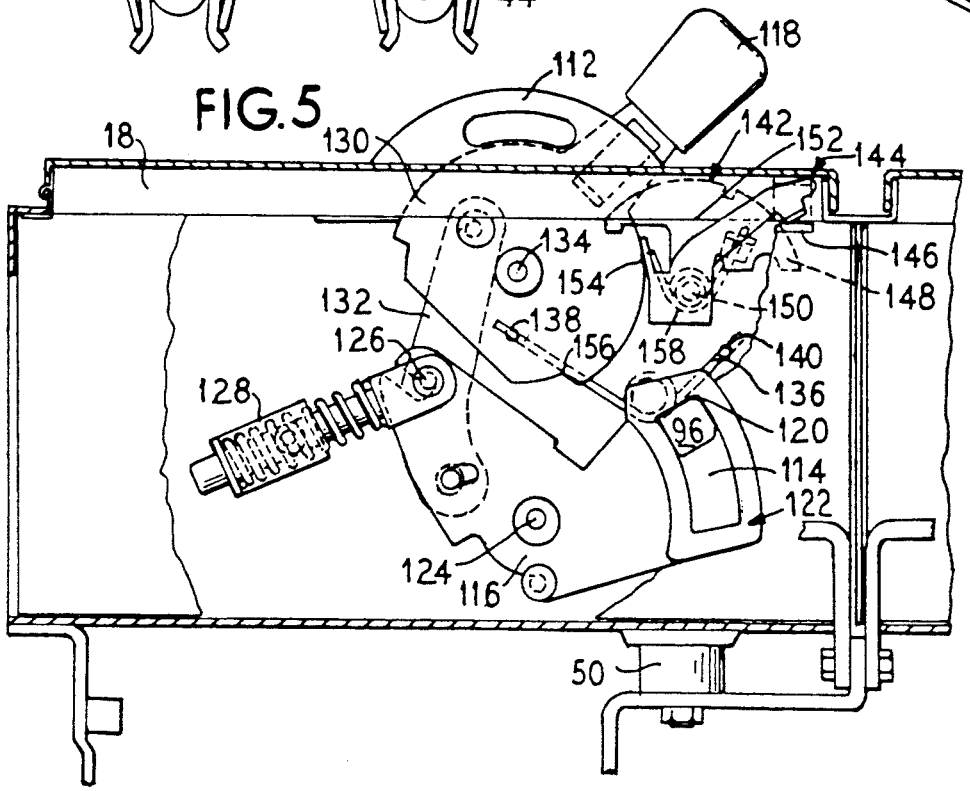
FIG. 5 is a sectional view taken along line V—V of FIG. 2 with the operating handle in the closed position and the cover in a locked position.

The operating mechanism assembly 112 is shown in more detail in FIG. 5. The handle 118 is shown in the ON position. The rotor 96 is positioned at slot end 120 within loss motion cam 116 which is connected to both an helical spring assembly 128 and to a handle cam 130 through connecting cam 132. The handle 118 is supported and pivots about a rivet 134 which connects to the side wall 28. Similarly, the loss motion cam 116 pivots about rivet 124 and the helical spring assembly 128 pivots about rivet 126 with rivet 124 connecting directly to the side wall 28. The movement of the handle 118 is assisted by a handle spring 136 secured at end 138 and affixed to the side wall 28 with a rivet 140.

A cover locking assembly 142 works in cooperation with the operating mechanism assembly 112 to act as a locking means for preventing the opening of the cover 18 when the handle 118 is in the ON position while preventing the handle 118 from moving from the OFF position when the cover 18 is open. The cover locking assembly 142 includes a projecting tab 144 which is secured to and extends perpendicularly from the cover 18. The tab 144 has a flange 146 which is positioned in a plane parallel to the cover 18. A locking cam 148 is attached to a pivot point 150 and includes a locking arm 152 to engage the flange 146 and a locking cam stop 154 to engage a cam stop 156 on the handle cam 130. The locking cam 148 is biased by a locking spring 158 to pivot the locking arm 152 in an upwardly direction to extend past the closed position of the cover 18. Simultaneously, the cam stop 154 of the locking assembly pivots in a downward direction to engage the corresponding cam stop 156 on the handle cam 150. Thus, when the cover 18 is open, the handle 118 cannot be moved from the OFF to ON position and accidental engaging of the switch contacts 76 is prevented. The locking assembly 142 can be by-passed for test purposes by opening the cover 18 and depressing the locking arm 152 in a downward direction. This movement will clear the cam stop 154 of the locking assembly from the cam stop 156 on the handle cam 130 allowing the handle to move from the OFF to ON position and close the switch contacts. To open the cover 18 for examination when the handle 118 is in the ON position, a screw driver or similar tool is inserted into a slot (not shown) near the flange 146 to disengage the locking arm 152.

Figure 6:
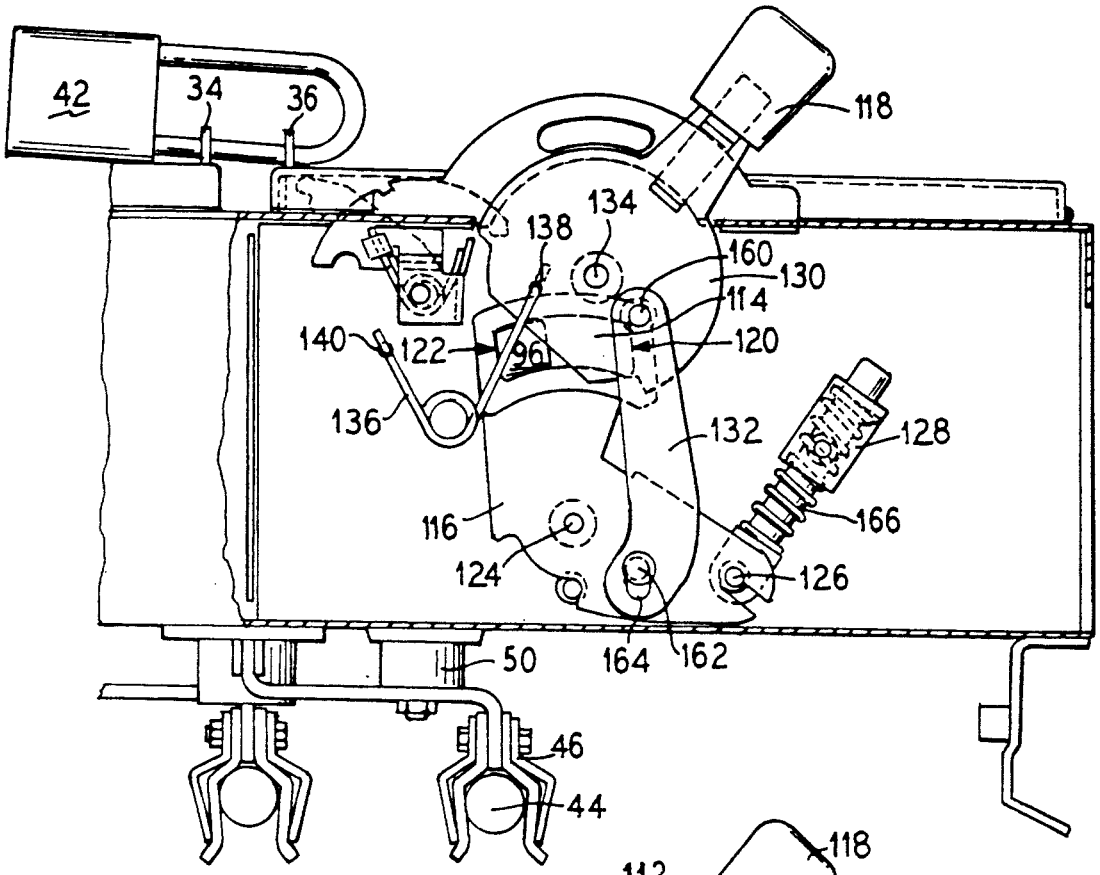
FIG. 6 is a sectional view taken along the line VI—VI of FIG. 2 with the operating handle in the open position.

The operation of the switch assembly 10 proceeds by movement of the handle 118 which is shown in the OFF position in FIG. 6. As a consequence, the connecting cam 132 is pulled by the handle cam 130 at pivot point 160 to engage the loss motion cam 116 at pivot point 162 which also moves in a slot 164. The movement of the loss motion cam 116 causes the helical spring assembly 128 to pivot about rivet 126 and begin to compress the helical spring 166. This stores energy in the helical spring assembly 128. Other means for storing energy such as a torsion bar or the like is also contemplated by the present invention. As the compression is occurring, the position of the rotor 96 in the slot 114 moves from slot end 122 to slot end 120. The movement of the handle cam 130 also compresses the handle spring 136.

Figure 7:
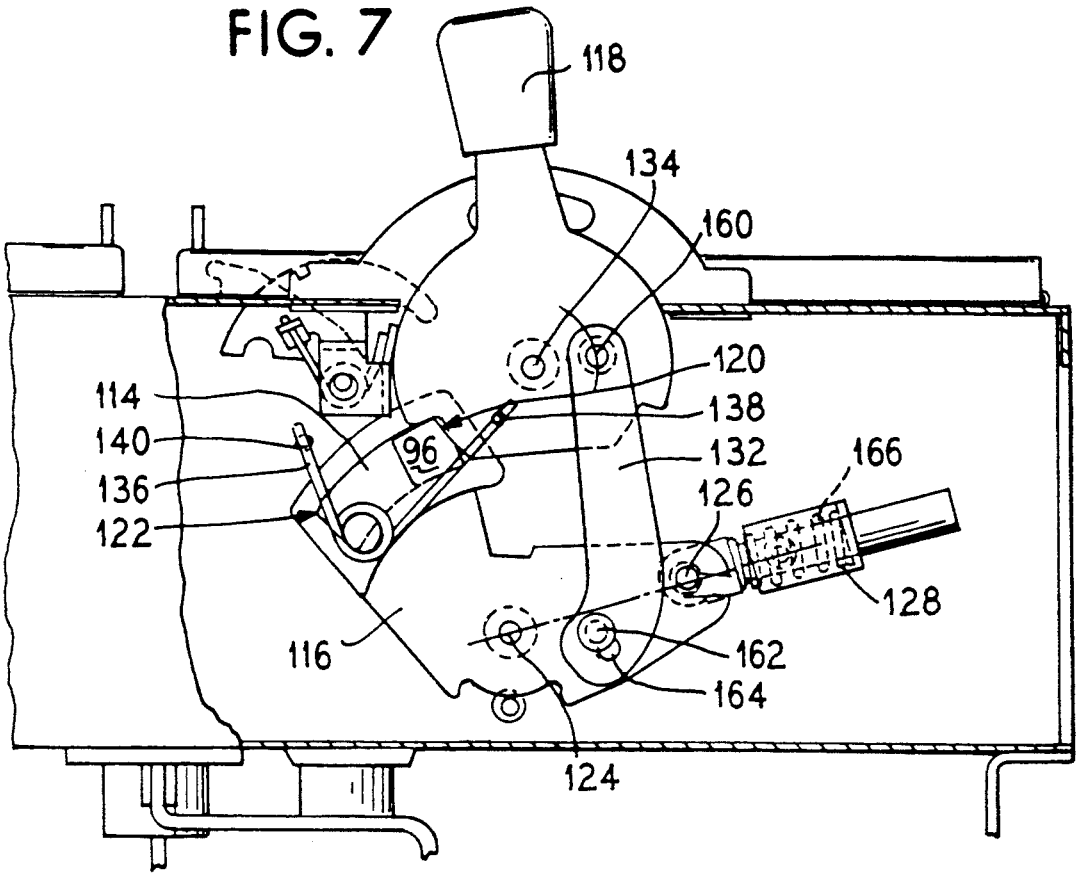
FIG. 7 is the sectional view of FIG. 6 with the operating handle beginning to advance from the open to the closed position.

As shown in FIG. 7, the helical spring 166 reaches maximum compression as the handle 118 is about to pass the center position. The handle spring 136 also approaches the release of its compression as the handle 118 passes the center position.

Figure 8:
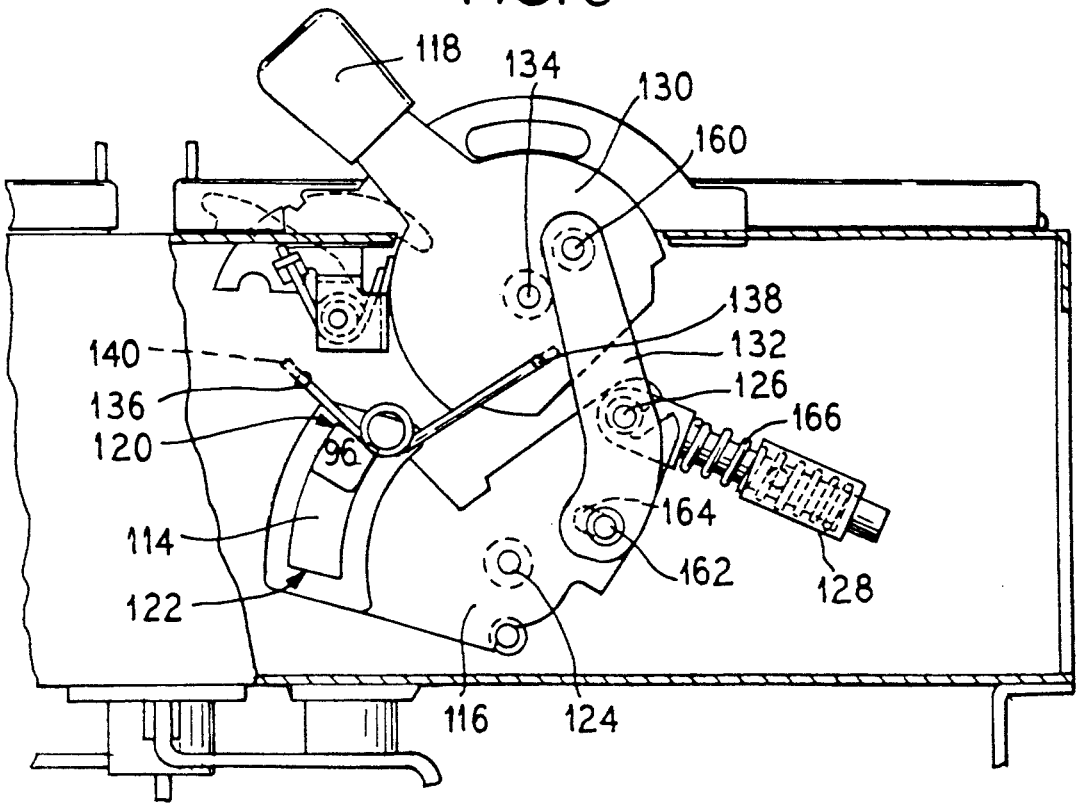
FIG. 8 is the sectional view of FIG. 6 with the operating handle advanced to the closed position.
Figure 9:
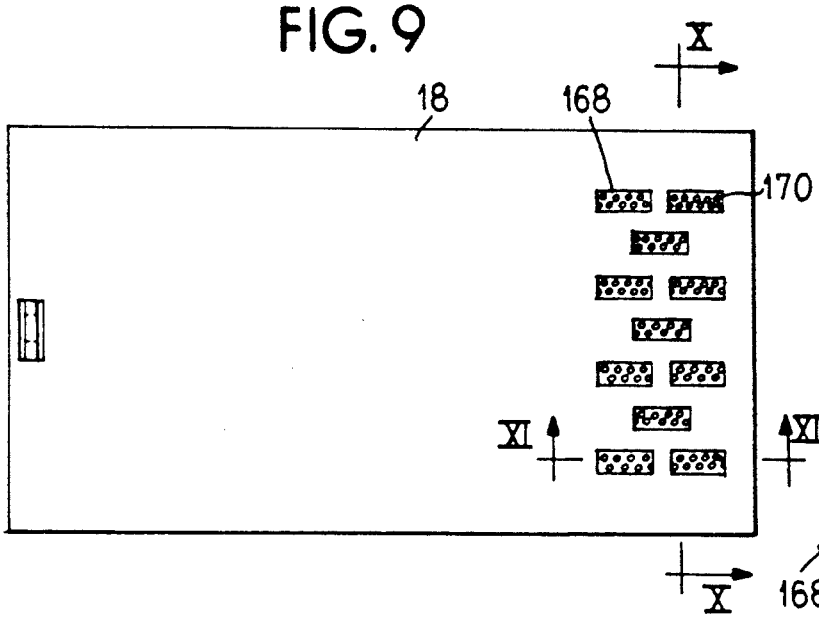
FIG. 9 is a top plan view of an alternate embodiment of the cover for the switch enclosure.
Figure 10:
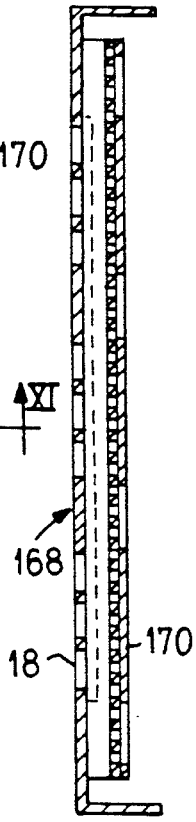
FIG. 10 is the sectional view taken along the line X—X of FIG. 9 illustrating the vents in the front cover.
Figure 11:
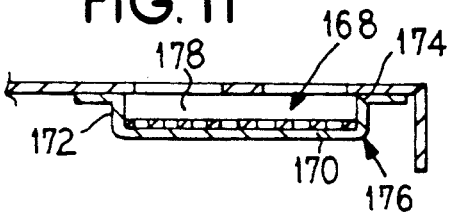
FIG. 11 is a partial sectional view taken along the line XI—XI of FIG. 9 illustrating another view of the vents in the front cover.

The center position of the handle 118 corresponds approximately with the centering of the helical spring assembly 128 and the loss motion cam 116 on pivot point 124 Once past the center position of the loss motion cam 116 there is an instant reaction caused by the sudden expansion of the compressed helical spring 166. The force supplied by the expansion of helical spring 166, slams the rotor 96 and corresponding knife blades 78 into engagement with the switch contacts 76. The resulting position of each of the switch components is detailed in FIG. 8 as the handle 118 comes to rest in the ON position. The expansion of the helical spring 166 also causes the pivot point 162 of the connecting cam 132 to change to the other side of slot 164 Similarly, the handle spring 136 expands once past the center position of the handle cam 130.

The loss motion cam 116 allows sufficient force to be stored in the helical spring 166 for the quick switch engagement before there is any movement in the rotor 96. The travel in slot 164 on the connecting cam 132 minimizes the impact felt on the handle 118 when the rotor 96 slams the knife blades 78 to engage the switch contacts 76.

The reverse movement of the handle 118 from the ON to the OFF position produces a similar compression of the helical spring 166 so as to make a quick and forceful disengagement of the knife blades 78 from the switch contacts 76. Again, the loss motion cam 116 allows the buildup of force in the helical spring 166 before the slot end 122 engages rotor 96. Also, impact on the handle 118 minimized by the slot 164 in the connecting cam 132 as the switch contacts 76 are quickly opened.

Preferably, the present invention includes means for venting the enclosure 12 to dissipate heat and arc gasses. Referring to FIGS. 9 through 14, various embodiments for venting the enclosure of the present invention are illustrated. The cover 18 is shown with a plurality of apertures 168 formed therein. Located in the plane beneath the cover 18 is a corresponding plurality of plates 170. Each plate 170 is of sufficient size to effectively cover the corresponding aperture 168. The plates 170 are held in position by tabs 172 extending in a perpendicular fashion between the edge of the aperture 174 and the corresponding edge on the plate 176. Channels 178 are formed by this arrangement between the plate 170 and the cover 18 which permits the circulation of air through to the interior of the enclosure 12. For safety reasons, however, the offset nature of the arrangement between the plates and the cover 18 prevents the accidental insertion of straight objects like rods, pens, fingers or the like directly into the enclosure's interior.

Figure 12:
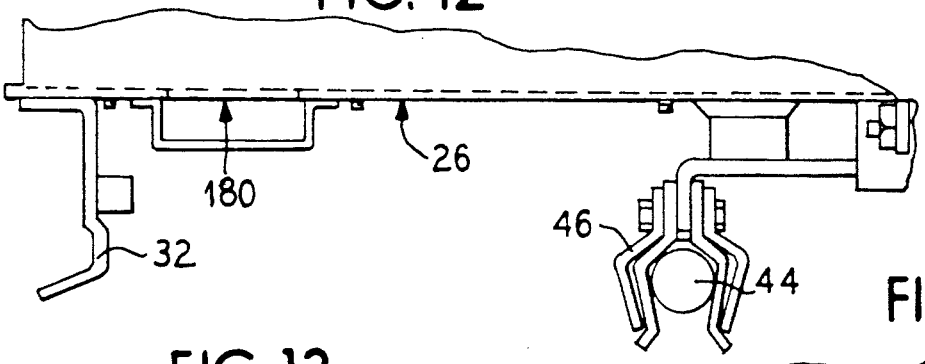
FIG. 12 is a partial side view of an alternate embodiment of the bottom wall of the switch enclosure illustrating vents extending thereto.
Figure 13:
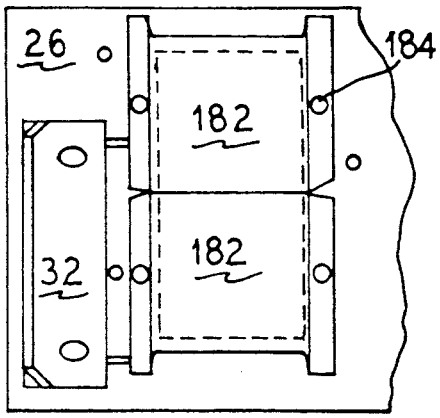
FIG. 13 is a partial bottom plan view of the alternate embodiment of FIG. 12 illustrating the vents thereon.
Figure 14:
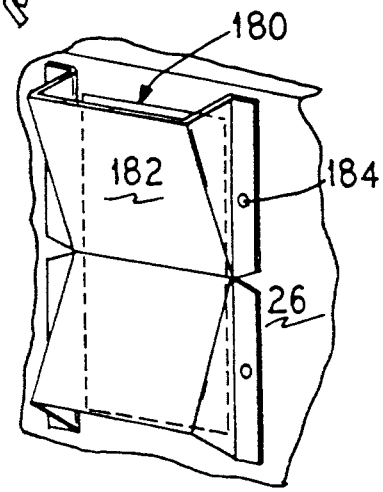
FIG. 14 is a partial bottom perspective view of the alternate embodiment of FIG. 12 illustrating the vents thereon.

FIGS. 12 through 14 specifically illustrate venting means for the back wall 26 of the enclosure. Since the back wall 26 is not as readily accessible to accidental penetration when the switch assembly 10 is installed in a switchboard, venting means in the back wall 26 need not be significantly offset to avoid this danger. Accordingly, a plurality of apertures 180 are positioned through the back wall 26. Placed over the apertures 180 are a pair of slanted covers 182 that are upstanding from the back wall 26. The slanted covers are fastened to the back wall 26 by a conventional means such as a screw 184. Preferably, the venting means is located in close proximity to the load side of the switch assembly 10 so as to dissipate the heat build-up from that area.

Figure 15:
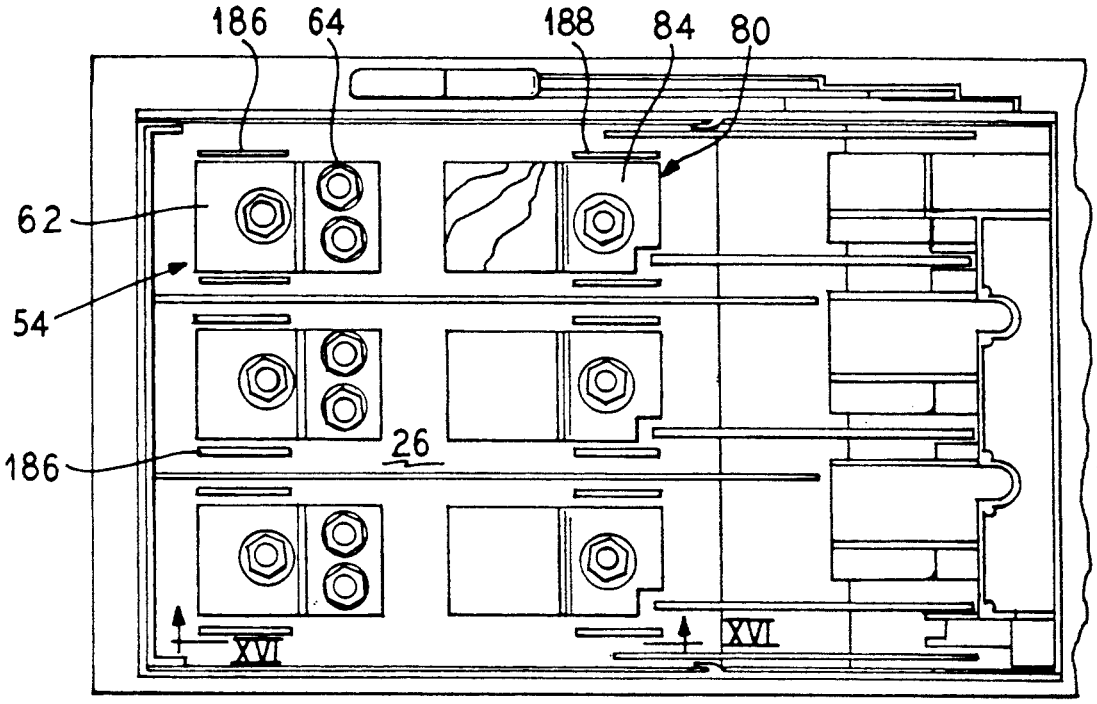
FIG. 15 is a partial top plan view of an alternate embodiment of the fuse switch with the cover removed illustrating the fuse lugs and heat sinks therein.
Figure 16:
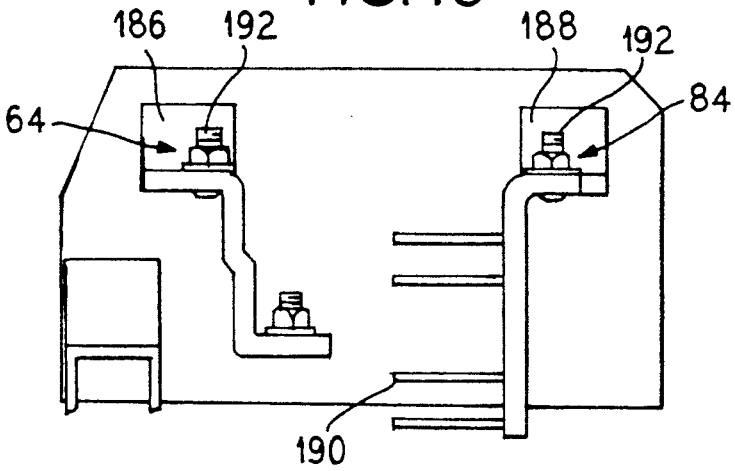
FIG. 16 is a partial sectional view taken along the line XVI—XVI of FIG. 15 illustrating the fuse lugs and heat sinks of an alternate embodiment of the switch of the present invention.

The present invention also preferably includes heat sinks for dissipating heat build-up created by the large amounts of power carried by the components of the switch assembly 10. Referring to FIGS. 15, and 16, there are heat sinks 186 positioned on each side of the load terminals 62. These heat sinks 186 are fastened to the load base assembly 54 and upstand in a perpendicular fashion therefrom. The heat sinks 186 help dissipate heat emanating from the load terminals 62 by providing additional surface area to permit cooling by contact with the surrounding air. Heat sinks 188 are also attached to the line terminals 80. Specifically, the heat sinks are attached to the fuse lug 84 and extend towards the back wall 26. Additional fins 190 are attached to the mounting bolts 192 to maximize the amount of surface area available for cooling. Preferably, the heat sinks 186 and 188 are made of steel. However, other metals which provide for the dissipation of heat such as copper may be used.

The present invention is preferably used with J-class fuses. Instead of using the fuse lugs previously discussed herein, it is desireable to use the fuse lugs illustrated in FIG. 15 with this fuse size. Specifically, the fuse is fastened to the fuse lugs 64 and 84 with a set of mounting bolts 192 which are torqued to about 45 to 50 in.-lbs. It should be understood, however, that fuses having a rating less than J-class may be used in the switch assembly 10 by modifying the fuse lugs appropriately.

The switch assembly of the present invention is suitable for operation in a circuit capable of delivering not more than 200,000 RMS symmetrical amperes, 600 volts maximum. For this circuit size, J-class fuses should be used. More particularly, using larger-sized load, line, and switch contacts to carry more power allows the switch to carry 30, 60, 100, 200, 400, or 600 amps at 600 volts AC or 250 volts DC.

The switch assembly 10 operates as a 250 volt DC switch or as a three phase 240 volt, 480 volt, or 600 volt AC switch. The respective horsepower ratings for the 30, 60, 100, 200, 400, and 600 amp switch are in the range of about 3 to 7.5; 7.5 to 15; 15 to 30; 25 to 60; 50 to 125; and 75 to 250 standard horsepower, and respectively in the range of about 7.5 to 20; 15 to 30; 25 to 60; 50 to 125; to 350; and 150 to 500 maximum horsepower. The respective DC horsepower rating ranges from about 5 for the 30 amp switch to about 50 for the 400 amp switch.

To emphasize the ability of the present invention to carry a higher voltage and larger current density in a smaller enclosure, the physical dimensions of the enclosure 12 illustrated in FIG. 1 for a dual three phase switch is about 23 in. long, about 6 in. wide, and about 7 in. deep. Preferably, the enclosure 12 is made of steel which contains a corrosion resistant zinc coating and an electrostatically deposited paint finish. The enclosure 12, however, can also be made of other materials such as a molded plastic material.

While particular embodiments and applications of the present applications of the present invention have been illustrated and described, it is to be understood that the invention is not limited to the precise construction disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A fusible switch for use in a circuit having at least one phase comprising:

an enclosure defining a switch interior formed by end walls, side walls, a back wall, and a front wall, the front wall having a cover removably connected thereto;

a base formed of an electrically insulating thermoplastic material, the base secured to the enclosure within the interior;

a pair of electrical terminals corresponding to each phase, each terminal secured on opposite ends of the base;

a knife blade and corresponding switch contact for each phase connected to one of the electrical terminals, each knife blade pivoting about the electrical terminal to disengagingly connect with the corresponding switch contact, each knife blade attached to a rotor, whereby, movement of the rotor simultaneously pivots each knife blade about a common axis between open and closed positions with each corresponding switch contact;

an operating mechanism secured directly to the side wall of the enclosure, the operating mechanism having a handle extending through the front wall of the enclosure, energy storage means connected to the handle for storing energy created by movement of the handle and subsequently releasing the energy, the energy storage means being a spring mounted on a pivot, the pivot positioned to compress the spring until the apex of the pivot is reached and to release the spring upon passing of the pivot, and lost motion means connecting the handle and energy storage means to the rotor, the lost motion means providing for the movement of the handle to store energy prior to engaging the rotor and applying the stored energy to the rotor to quickly engage or disengage the knife blade and switch contact; and a pair of fuse lugs for each phase; each fuse lug connected to one of the electrical terminals.

2. The switch defined in claim 1 wherein the lost motion means is a cam having a slot contained therein for receiving the rotor, the cam pivotally connected to the handle and energy storage means on the end opposite the slot, the rotor moving in the slot as the handle advances to store energy in the energy storage means, the rotor engaging the other end of the slot as the energy storage means releases its stored energy.

3. The switch defined in claim 1 wherein the operating mechanism further includes means for locking the cover to the enclosure when the handle is in the ON position and preventing the handle from moving while in the OFF position when the cover is open.

4. The switch defined in claim 3 wherein the locking means includes a locking arm pivotally connected to the front wall for engaging the handle when the cover is open to prevent movement of the handle, pivoting to engage the cover as it is closed and locking the cover when the handle is moved to the ON position.

5. The switch defined in claim 1 wherein the switch further includes a heat sink connected to the terminals to effectively provide additional surface area for dissipating heat.

6. The switch defined in claim 5 wherein the heat sink is formed of relatively thin, metallic fins.

7. The switch defined in claim 1 wherein the switch further includes means for venting the enclosure to allow the circulation of air in proximity to the terminals.

8. The switch defined in claim 1 wherein the fuse lugs are adapted to receive a J-class fuse.

9. A fusible switch for use in a circuit having at least one phase comprising:

an enclosure defining a switch interior formed by end walls, side walls, a back wall, and a front wall, the front wall having a cover removably connected thereto;

a base formed of an electrically insulating thermoplastic material, the base secured to the enclosure within the interior;

a pair of electrical terminals corresponding to each phase, each terminal secured on opposite ends of the base;

a knife blade and corresponding switch contact for each phase connected to one of the electrical terminals, each knife blade pivoting about the electrical terminal to disengagingly connect with the corresponding switch contact, each knife blade attached to a rotor, whereby, movement of the rotor simultaneously pivots each knife blade about a common axis between open and closed positions with each corresponding switch contact;

an operating mechanism secured directly to the side wall of the enclosure, the operating mechanism having a handle extending through the front wall of the enclosure, energy storage means connected to the handle for storing energy created by movement of the handle and subsequently releasing the energy, and lost motion means connecting the handle and energy storage means to the rotor, the lost motion means providing for the movement of the handle to store energy prior to engaging the rotor and applying the stored energy to the rotor to quickly engage or disengage the knife blade and switch contact;

a pair of fuse lugs for each phase, each fuse lug connected to one of the electrical terminals; and means for venting the enclosure to allow the circulation of air in proximity to the terminals, the venting means including at least one aperture in the cover and a corresponding plate mounted beneath each aperture in a plane parallel to the cover, the size of the plate being sufficient to entirely cover the aperture, the plate held in position by a plurality of supports extending perpendicularly between the edge of each aperture and plate to define a channel therebetween, whereby, air is allowed to circulate through the channel defined between each aperture and plate into the interior of the enclosure.

10. A fusible switch for use in a circuit having at least one phase comprising:

an enclosure defining a switch interior formed by end walls, side walls, a back wall, and a front wall, the front wall having a cover removably connected thereto;

a base formed of an electrically insulating thermoplastic material, the base secured to the enclosure within the interior;

a pair of electrical terminals corresponding to each phase, each terminal secured on opposite ends of the base;

a knife blade and corresponding switch contact for each phase connected to one of the electrical terminals, each knife blade pivoting about the electrical terminal to disengagingly connect with the corresponding switch contact, each knife blade attached to a rotor, whereby, movement of the rotor simultaneously pivots each knife blade about a common axis between open and closed positions with each corresponding switch contact;

an operating mechanism secured directly to the side wall of the enclosure, the operating mechanism having a handle extending through the front walls of the enclosure, energy storage means connected to the handle for storing energy created by movement of the handle and subsequently releasing the energy, and lost motion means connecting the handle and energy storage means to the rotor, the lost motion means providing for the movement of the handle to store energy prior to engaging the rotor and applying the stored energy to the rotor to quickly engage or disengage the knife blade and switch contact;

a pair of fuse lugs for each phase, each fuse lug connected to one of the electrical terminals; and means for venting the enclosure to allow the circulation of air in proximity to the terminals, the venting means including at least one aperture in the back wall of the enclosure in close proximity to the electrical terminals therein and a slanted cover extending over the aperture, the slanted cover being attached to the back wall near the edge of the aperture except for one end of the slanted cover being raised to define a channel between the back wall and the slanted cover, whereby, air is allowed to circulate through the channel into the interior of the enclosure.

11. A fusible switch for use in a circuit having at least one phase comprising:

an enclosure defining a switch interior formed by end walls, side walls, a back wall, and a front wall, the front wall having a cover removably connected thereto;

a base formed of an electrically insulating thermoplastic material, the base secured to the enclosure within the interior;

a pair of electrical terminals corresponding to each phase, each terminal secured on opposite ends of the base;

a knife blade and corresponding switch contact for each phase connected to one of the electrical terminals, each knife blade pivoting about the electrical terminals, each knife blade pivoting about the electrical terminal to disengagingly connect with the corresponding switch contact, each knife blade attached to a rotor, whereby, movement of the rotor simultaneously pivots each knife blade about a common axis between open and closed positions with each corresponding switch contact;

an operating mechanism secured directly to the side wall of the enclosure, the operating mechanism having a handle extending through the front wall of the enclosure, energy storage means connected to the handle for storing energy created by movement of the handle and subsequently releasing the energy, and lost motion means connecting the handle and energy storage means to the rotor, the lost motion means providing for the movement of the handle to store energy prior to engaging the rotor and applying the stored energy to the rotor to quickly engage or disengage the knife blade and switch contact; and a pair of fuse lugs for each phase, each fuse lug connected to one of the electrical terminals, the switch being suitable for use on a three phase circuit capable of delivering in the range of about 30 amps to about 600 amps at 600 volts AD/240 volts DC.

12. A fusible switch for use in a circuit having at least one phase comprising:

an enclosure defining a switch interior formed by end walls, side walls, a back wall, and a front wall, the front walls having a cover removably connected thereto;

a base formed of an electrically insulating thermoplastic material, the base secured to the enclosure within the interior;

a pair of electrical terminals corresponding to each phase, each terminal secured on opposite ends of the base;

a knife blade and corresponding switch contact for each phase connected to one of the electrical terminals, each knife blade pivoting about the electrical terminal to disengagingly connect with the corresponding switch contact, each knife blade attached to a rotor, whereby, movement of the rotor simultaneously pivots each knife blade about a common axis between open and closed positions with each corresponding switch contact;

an operating mechanism secured within the enclosure, the operating mechanism having a handle extending through the front wall of the enclosure, the handle connected to the rotor to control the opening and closing of the knife blades and switch contacts;

a heat sink connected to the terminals to effectively provide additional surface area for dissipating heat;

means for venting the enclosure to allow the circulation of air in proximity to the terminals, the venting means includes at least one aperture in the cover and a corresponding plate mounted beneath each aperture in a plane parallel to the cover, the size of the plate being sufficient to entirely cover the aperture, the plate held in position by a plurality of supports extending perpendicularly between the edge of each aperture and plate to define a channel therebetween, whereby, air is allowed to circulate through the channel defined between each aperture and plate into the interior of the enclosure; and a pair of fuse lugs for each phase, each fuse lug connected to one of the terminals.

13. The switch defined in claim 12 wherein the venting means includes at least one aperture in the back wall of the enclosure in close proximity to the electrical terminals therein and a slanted cover extending over the aperture, the slanted cover being attached to the back wall near the edge of the aperture except for one end of the slanted cover being raised to define a channel between the back wall and the slanted cover, whereby, air is allowed to circulate through the channel into the interior of the enclosure.

14. The switch defined in claim 12 wherein the operating mechanism further includes means for locking the cover to the enclosure when the handle is in the ON position and preventing the handle from moving while in the OFF position when the cover is open.

15. The switch defined in claim 14 wherein the locking means includes a locking arm pivotally connected to the front wall for engaging the handle when the cover is open to prevent movement of the handle, pivoting to engage the cover as it is closed and locking the cover when the handle is moved to the ON position.

16. A fusible switch for use in a multiphase circuit comprising:

an enclosure formed by end walls, side walls, a back wall, and a front wall, the enclosure defining an interior to house a plurality of switch units, the front wall having a cover removably connected thereto for each switch unit;

a line feed bar having contact jaws mounted thereon for electrically connecting with each phase of the circuit, the opposite end of the line feed bar extending through the back wall of the enclosure to each switch unit;

each switch unit having:

(a) a base formed of an electrically insulating thermoplastic material, the base secured to the enclosure within the interior;

(b) a line terminal and a load terminal corresponding to each phase, each terminal secured on opposite ends of the base, the line terminal connecting to the line feed bar, the load terminal connecting to a load line extending through the end walls of the enclosure;

(c) a knife blade and corresponding switch contact for each phase connected to the line terminal, each knife blade pivoting about the line terminal to disengagingly connect with the corresponding switch contact, each knife blade attached to a rotor, whereby, movement of the rotor simultaneously pivots each knife blade about a common axis between open and closed positions with each corresponding switch contact;

(d) an operating mechanism secured directly to the side wall of the enclosure, the operating mechanism having a handle extending through the front wall of the enclosure, energy storage means connected to the handle for storing energy created by movement of the handle and subsequently releasing the energy, the energy storage means being a spring mounted on a pivot, the pivot being positioned to compress the spring until the apex of the pivot is reached and to release the spring upon passing the apex of the pivot, and lost motion means connecting the handle and energy storage means to the rotor, the lost motion means providing for the movement of the handle to store energy prior to engaging the rotor and applying the stored energy to the rotor to quickly engage or disengage the knife blade and switch contact; and (e) a fuse lug connected to each line terminal and load terminal.

17. The switch defined in claim 16 wherein the lost motion means is a cam having a slot contained therein for receiving the rotor, the cam pivotally connected to the handle and energy storage means on the end opposite the slot, the rotor moving in the slot as the handle advances to store energy in the energy storage means, the rotor engaging the other end of the slot as the energy storage means releases its stored energy.

18. The switch defined in claim 16 wherein the operating mechanism includes a locking arm pivotally connected to the front wall for engaging the handle when the cover is open to prevent movement of the handle, pivoting to engage the cover as it is closed and locking the cover when the handle is moved to the ON position.

19. The switch defined in claim 16 wherein the switch further includes a heat sink connected to the terminals to effectively provide additional surface area for dissipating heat.

20. The switch defined in claim 16 wherein each switch unit further includes at least one aperture in the cover and a corresponding plate mounted beneath each aperture in a plane parallel to the cover, the size of the plate being sufficient to entirely cover the aperture, the plate held in position by a plurality of supports extending perpendicularly between the edge of each aperture and plate to define a channel therebetween, whereby, air is allowed to circulate through the channel defined between each aperture and plate into the interior of the enclosure.

21. The switch defined in claim 16 wherein each switch unit further includes at least one aperture in the back wall of the enclosure in close proximity to the electrical terminals therein and a slanted cover extending over the aperture, the slanted cover being attached to the back wall near the edge of the aperture except for one end of the slanted cover being raised to define a channel between the back wall and the slanted cover, whereby, air is allowed to circulate through the channel into the interior of the enclosure.

22. The switch defined in claim 16 wherein the fuse lugs are adapted to receive a J-class fuse.

23. A fusible switch for use in a multiphase circuit comprising:

an enclosure formed by end walls, side walls, a back wall, and a front wall, the enclosure defining an interior to house a plurality of switch units, the front wall having a cover removably connected thereto for each switch unit;

a line feed bar having contact jaws mounted thereon for electrically connecting with each phase of the circuit, the opposite end of the line feed bar extending through the back wall of the enclosure to each switch unit;

each switch unit having:

(a) a base formed of an electrically insulating thermoplastic material, the base secured to the enclosure within the interior;

(b) a line terminal and a load terminal corresponding to each phase, each terminal secured on opposite ends of the base, the line terminal connecting to the line feed bar, the load terminal connecting to a load line extending through the end walls of the enclosure;

(c) a knife blade and corresponding switch contact for each phase connected to the line terminal, each knife blade pivoting about the line terminal to disengagingly connect with the corresponding switch contact, each knife blade attached to a rotor, whereby, movement of the rotor simultaneously pivots each knife blade about a common axis between open and closed positions with each corresponding switch contact;

(d) an operating mechanism secured directly to the side wall of the enclosure, the operating mechanism having a handle extending through the front wall of the enclosure, energy storage means connected to the handle for storing energy created by movement of the handle and subsequently releasing the energy, and lost motion means connecting the handle and energy storage means to the rotor, the lost motion means providing for the movement of the handle to store energy prior to engaging the rotor and applying the stored energy to the rotor to quickly engage or disengage the knife blade and switch contact; and (e) a fuse lug connected to each line terminal and load terminal, the switch being suitable for use on a three phase circuit capable of delivering in the range of about 30 amps to about 600 amps at 600 volts AC/240 volts DC.

* * * * *